United States Patent [19]

Baum et al.

[11] Patent Number: 4,713,643

[45] Date of Patent: Dec. 15, 1987

[54] LOW LOSS CIRCUIT BREAKER AND ACTUATOR MECHANISM THEREFOR

[75] Inventors: Samuel Baum, Redwood City; John R. Yaeger, Sunnyvale, both of Calif.

[73] Assignee: Raychem Corporation, Menlo Park, Calif.

[21] Appl. No.: 945,927

[22] Filed: Dec. 23, 1986

[51] Int. Cl.[4] ..... H01H 71/16
[52] U.S. Cl. ..... 337/140; 337/76
[58] Field of Search ..... 337/140, 76

[56] References Cited

U.S. PATENT DOCUMENTS

| | | | |
|---|---|---|---|
| 3,483,360 | 12/1969 | Perry | 219/512 |
| 3,594,674 | 7/1971 | Willson | 337/139 |
| 3,613,732 | 10/1971 | Willson et al. | 137/625.44 |
| 3,634,803 | 1/1972 | Willson et al. | 337/123 |
| 3,652,969 | 3/1972 | Willson et al. | 337/140 |
| 3,676,815 | 7/1972 | Du Rocher | 337/140 |
| 3,707,694 | 12/1972 | DuRocher | 337/139 |
| 3,849,756 | 11/1974 | Hickling | 337/382 |
| 3,872,415 | 3/1975 | Clarke | 337/140 |
| 3,968,380 | 7/1976 | Jost et al. | 307/99 |
| 4,517,543 | 5/1985 | Brubaker | 337/140 |
| 4,565,589 | 1/1986 | Harrison | 148/402 |

FOREIGN PATENT DOCUMENTS 2026246A 1/1980 United Kingdom .

OTHER PUBLICATIONS

"Control Design with VEASE TM", Raychem Corporation (copyright 1982).

*Primary Examiner*—Harold Broome
*Attorney, Agent, or Firm*—Ira D. Blecker; Herbert G. Burkard

[57] ABSTRACT

There is disclosed a low loss circuit breaker including a housing, two exterior contacts, a pivotable arm, a means for biasing, a bifurcated member and a shape memory alloy element. The pivotable arm has a latching portion and a contact portion with the contact portion in electrical contact with one of the exterior contacts. The means for biasing exerts a biasing force with respect to the pivotable arm. The bifurcated member has a contact arm in touching relationship with the contact portion of the pivotable arm and is in electrical contact with the one of the exterior contacts through the contact portion of the pivotable arm. The bifurcated member further has a flexure arm cooperating with the latching portion of the pivotable arm wherein the flexure arm releasably restrains the pivotable arm against the biasing force exerted by the biasing means. The shape memory alloy element is operatively connected between the other of the exterior contacts and the flexure arm wherein when the shape memory alloy element is heated, the shape memory alloy element cooperates with the flexure arm to remove the restraining of the pivotable arm. Thereafter the pivotable arm is released so as to pivot and break the electrical contact between the contact portion of the pivotable arm, the contact arm and the one of the exterior contacts.

10 Claims, 3 Drawing Figures

LOW LOSS CIRCUIT BREAKER AND ACTUATOR MECHANISM THEREFOR

BACKGROUND OF THE INVENTION

This invention relates to the field of actuator mechanisms and circuit breakers and more particularly relates to actuator mechanisms and circuit breakers incorporating shape memory alloys.

Various relays, circuit breakers, thermostatic switches and other electromechanical devices have been proposed utilizing shape memory alloys. Among these are: Perry U.S. Pat. No. 3,483,360; Willson U.S. Pat. No. 3,594,674; Willson et al U.S. Pat. Nos. 3,613,732; 3,634,803; and 3,652,969; Du Rocher U.S. Pat. Nos. 3,676,815 and 3,707,694; Hickling U.S. Pat. No. 3,849,756; Clarke U.S. Pat. No. 3,872,415; Jost et al U.S. Pat. No. 3,968,380; Melton et al U.S. Pat. No. 4,205,293; Brubaker U.S. Pat. No. 4,517,543; and Sims U.K. Patent Application No. 2,026,246A.

These devices typically take advantage of the shape memory effect to trip a switch or break a contact upon reaching a critical temperature.

The phenomenon of shape memory is, of course, well known. The ability to possess shape memory is a result of the fact that the shape memory alloy undergoes a reversible transformation from an austenitic state to a martensitic state with a change in temperature. An article made of such an alloy is easily deformed from its original configuration to a new configuration when cooled below the temperature at which the alloy is transformed from the austenitic state to the martensitic state. The temperature at which this transformation begins is usually referred to as the $M_s$ temperature and the temperature at which this transformation is complete is the $M_f$ temperature. When an article thus deformed is warmed to the temperature at which the alloy starts to revert back to austenite, referred to as the $A_s$ temperature, the deformed object will begin to return to its original configuration. The reversion of the alloy will be complete upon reaching the $A_f$ temperature.

Notwithstanding the past efforts devoted to developing electromechanical devices, including those incorporating various shape memory alloys, there has arisen the need for an electromechanical device, in particular a circuit breaker, which is relatively small in size, compact and suitable for use under low amperage (½ amp or less) as well as high amperage conditions. It would be highly desirable for this electromechanical device to have low insertion loss. Until the present invention, such a device did not exist.

Accordingly, it is an object of the invention to have an electromechanical device which is relatively small in size, compact and suitable for use under low amperage as well as high amperage conditions.

It is a further object of the invention to have such an electromechanical device for use as a circuit breaker.

It is yet another object of the invention to have such an electromechanical device for use as a circuit breaker having low insertion loss.

These and other objects of the invention will become more apparent after referring to the following description considered in conjunction with the accompanying drawings.

BRIEF SUMMARY OF THE INVENTION

The very heart of the invention lies in an actuator mechanism which comprises a pivotable arm having a latching portion and a contact portion; a means for biasing exerting a biasing force with respect to said pivotable arm; a bifurcated member; and a shape memory alloy element. The bifurcated member has a contact arm in touching relationship with the contact portion of the pivotable arm and a flexure arm cooperating with the latching portion of the pivotable arm. The flexure arm releasably restrains the pivotable arm against the biasing force exerted by the biasing means. The shape memory alloy element is operatively connected to the flexure arm wherein when the shape memory alloy element is heated the shape memory alloy element cooperates with the flexure arm to remove the restraining of the pivotable arm. In this manner the pivotable arm is released to pivot and break the touching relationship of the contact portion of the pivotable arm and the contact arm.

One particularly preferred use of the actuator mechanism is in a circuit breaker. The actuator mechanism would then further include a housing and two exterior contacts to complete the circuit breaker.

As will become apparent hereafter, the actuator mechanism and the circuit breaker have achieved the objects of the invention by being relatively small in size, compact and suitable for use under low amperage as well as high amperage conditions.

DETAILED DESCRIPTION OF THE INVENTION

According to the invention there is disclosed an actuator mechanism comprising a pivotable arm having a latching portion and a contact portion; a means for biasing exerting a biasing force with respect to the pivotable arm; and a bifurcated member having a contact arm in touching relationship with the contact portion of the pivotable arm and a flexure arm cooperating with the latching portion of the pivotable arm, the flexure arm releasably restraining the pivotable arm against the biasing force exerted by the biasing means. The actuator mechanism further comprises a shape memory alloy element operatively connected to the flexure arm wherein when the shape memory alloy element is heated, the shape memory alloy element cooperates with the flexure arm to remove the restraining of the pivotable arm, thereby releasing the pivotable arm to pivot and break the touching relationship of the contact portion of the pivotable arm and the contact arm.

There is further disclosed according to the invention a low loss circuit breaker comprising a housing, two exterior contacts (one at each end of the housing), a pivotable arm, a means for biasing, a bifurcated member and a shape memory alloy element. The pivotable arm has a latching portion and a contact portion with the contact portion in electrical contact with one of the exterior contacts. The means for biasing exerts a biasing force with respect to the pivotable arm. The bifurcated member has a contact arm in touching relationship with the contact portion of the pivotable arm and is in electrical contact with the one of the exterior contacts through the contact portion of the pivotable arm. The bifurcated member further has a flexure arm cooperating with the latching portion of the pivotable arm wherein the flexure arm releasably restrains the pivotable arm against the biasing force exerted by the biasing means. The shape memory alloy element is operatively connected between the other of the exterior contacts and the flexure arm wherein when the shape memory alloy element is heated, the shape memory alloy element cooperates with the flexure arm to remove the restaining of the pivotable arm. Thereafter the pivotable arm is released so as to pivot and break the electrical contact between the contact portion of the pivotable arm, the contact arm and the one of the exterior contacts.

Figure 1:
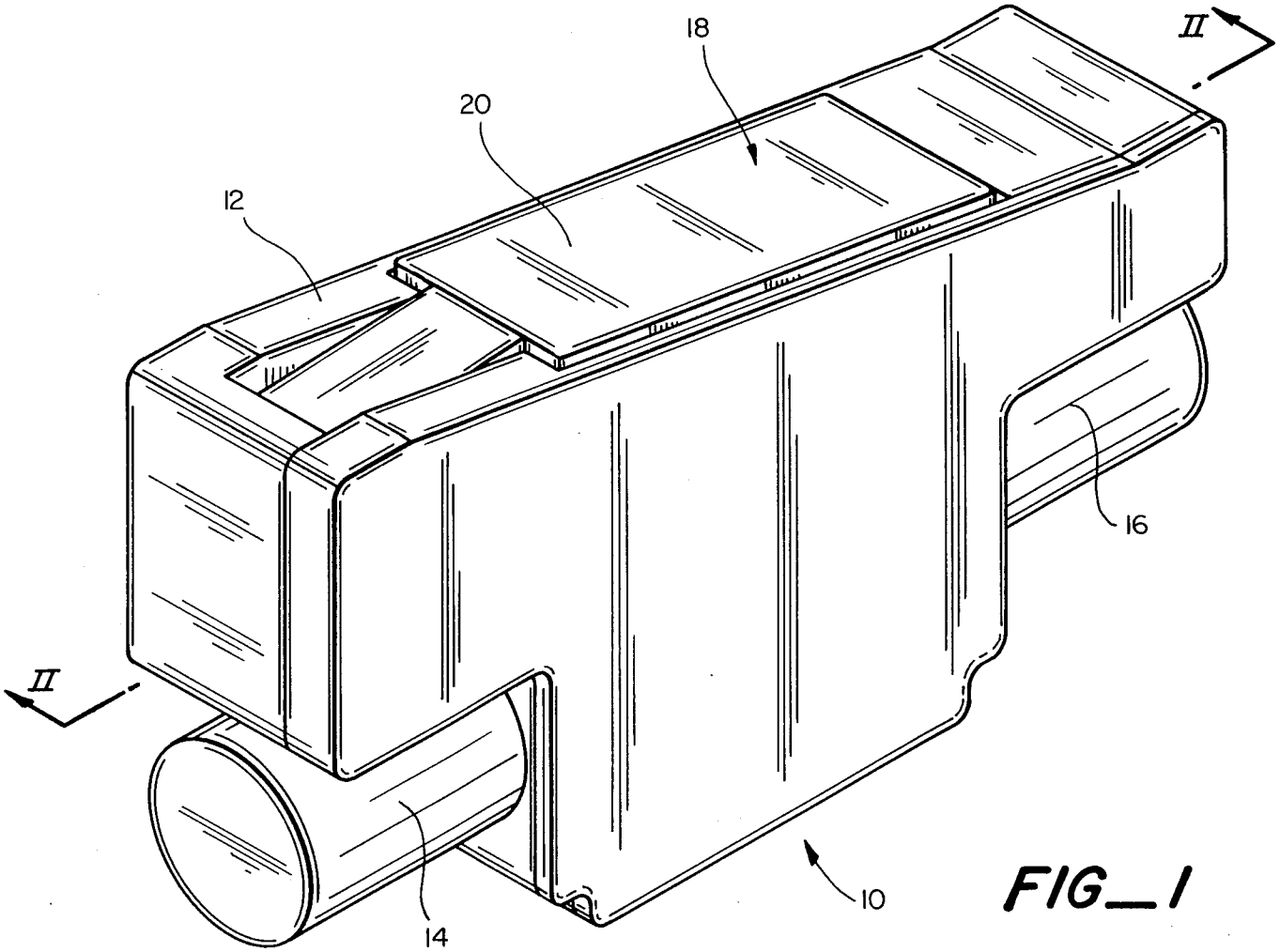
FIG. 1 is a perspective view of a circuit breaker according to the invention.

Referrring to the figures in more detail and particularly referring to FIG. 1 there is illustrated the circuit breaker 10 according to the invention. The circuit breaker 10 has a housing 12 with two exterior contacts 14,16. In a preferred embodiment these exterior contacts are barrel contacts. Also shown in FIG. 1 is a means for indicating 18 when the circuit breaker has been tripped. This indicating means will be discussed in more detail hereafter.

Figure 2:
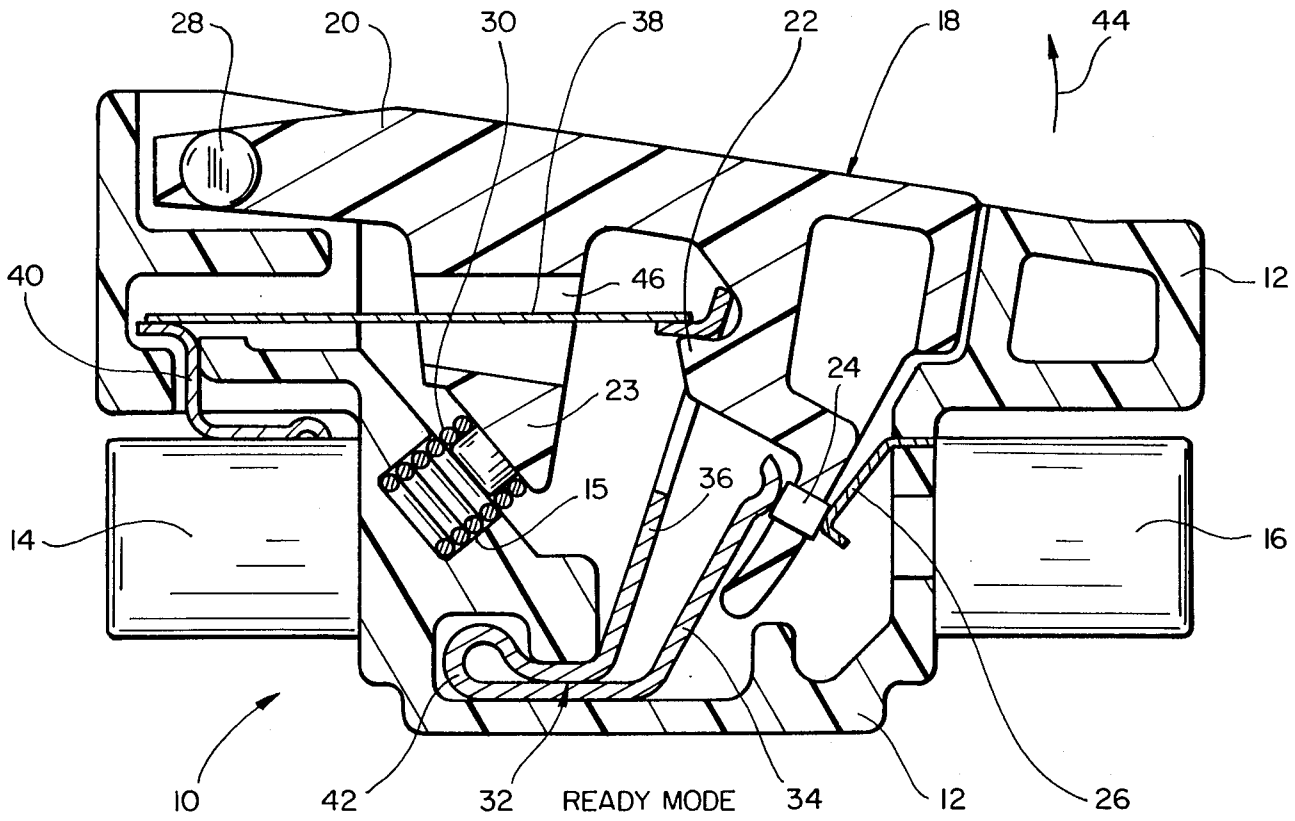
FIG. 2 is a sectional view along the lines II—II of FIG. 1 of a circuit breaker according to the invention in the "ready" mode.

Referring now to FIG. 2, there is shown in cross section the circuit breaker of FIG. 1 in the "ready" mode. By "ready" mode, it is meant that the circuit breaker has not yet been subjected to an electrical or current overload condition. As discussed above, the circuit breaker 10 includes a housing 12 and two exterior contacts 14,16. The contacts 14,16 are at opposte ends of the housing. The circuit breaker has a pivotable arm 20 having a latching portion 22 and a contact portion 24 with the contact portion 24 being in electrical contact with one of the exterior contacts. As shown in FIG. 2, this would be contact 16. The contact portion 24 may contact the exterior contact 16 directly or, as shown in FIG. 2, may contact the exterior contact 16 through an extension 26 of the exterior contact 16. Pivotable arm 20 is connected to the housing 12 via some means such as axle 28. Means for biasing 30 exerts a biasing force with respect to abutting portion 23 of the pivotable arm 20. The biasing means 30 sits within recess 15 of the housing 12. The preferred biasing means 30 is a spring as shown in FIG. 2. The circuit breaker also includes a bifurcated member, generally indicated by 32, having a contact arm 34 in touching relationship with the contact portion 24 of the pivotable arm. The contact arm 34 is also in electrical contact with the one 16 of the exterior contacts through the contact portion 24 of the pivotable arm. The bifurcated member 32 also comprises a flexure arm 36 cooperating with the latching portion 22 of the pivotable arm. The flexure arm 36 releasably restrains the pivotable arm 20 against the biasing force exerted by the biasing means 30. Shape memory alloy element 38 is operatively connected between the other 14 of the exterior contacts and the flexure arm 36. As discussed previously with respect to exterior contact 16 the shape memory alloy element 38 may be directly connected to the exterior contact or may be connected thereto by an extension 40. The shape memory alloy element 38 may be a wire, spring, strip or other suitable configuration as will be apparent to one skilled in the art. As shown in FIG. 2 the shape memory alloy element 38 is a wire and is in the deformed (extended length) condition. As further shown in FIG. 2 the shape memory alloy element 38 is directly connected to the flexure arm 36 and to the extension 40 of exterior contact 14. The shape memory alloy element however may be directly connected to exterior contact 14 such as by soldering, conductive adhesives or other means such as will be apparent to one skilled in the art. Such modifications of the invention are, of course, also within the scope of the invention.

The bifurcated element 32 may be made of a single piece of material which has bent around at 42 as shown in FIG. 2. Alternatively, the bifurcated member may be made of two pieces or strips of material and joined together such as by screws or soldering. However, what is important is that the flexure arm 36 and the contact arm 34 be in electrical contact as will become apparent shortly. The preferred material for the bifurcated element is beryllium copper; however other electrically conducting materials are also suitable for the purposes of the invention.

The electrical circuit formed by the electrical circuit breaker is as follows. Current is conducted through the exterior contact 14 via the extension 40 of the exterior contact and then through the shape memory alloy element 38. Thereafter, current passes through the flexure arm 36 to the contact arm 34 and then through the contact portion 24 of the pivotable arm 20. Finally, current is conducted to the contact extension 26 and out to exterior contact 16. When the electrical circuit is complete as just described the circuit breaker is in the ready mode. At this point indicating means 18 is down flush with the housing 12.

Figure 3:
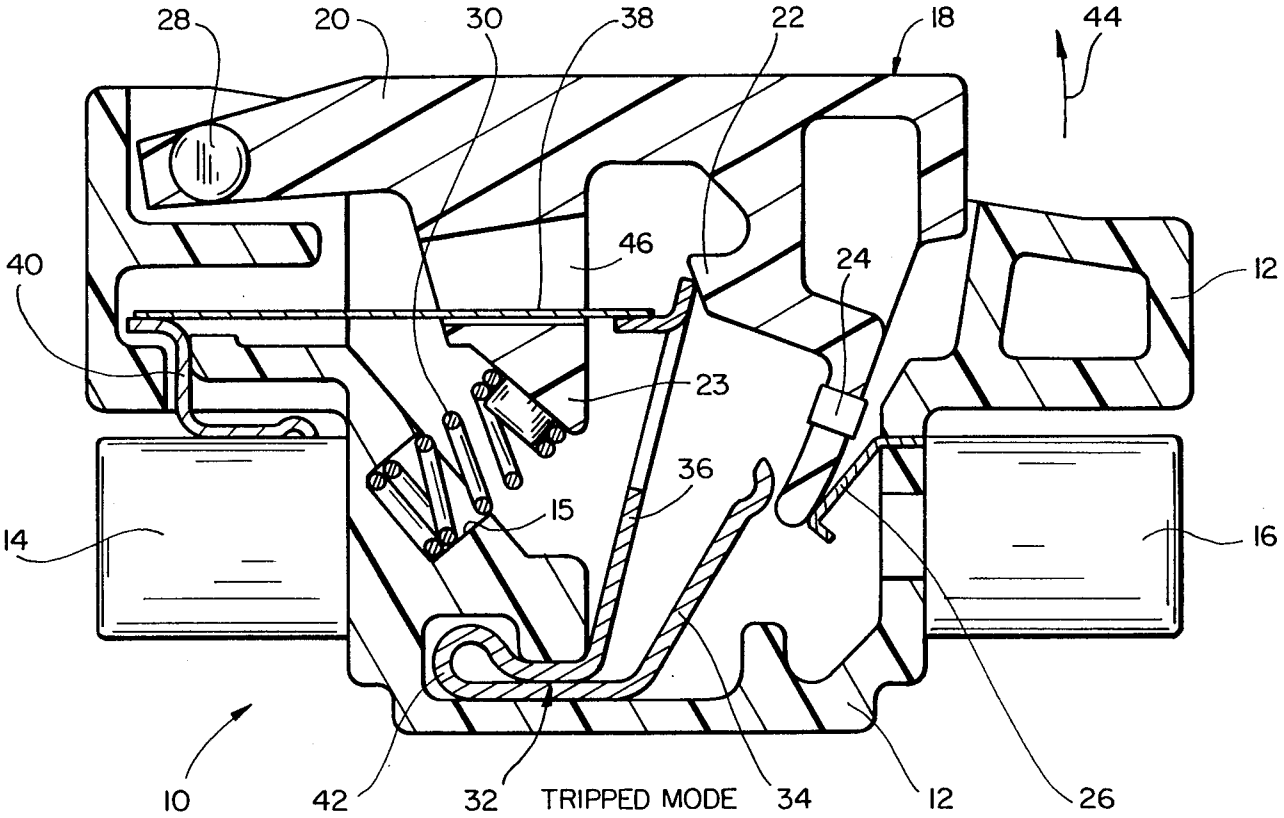
FIG. 3 is a view of the circuit breaker of FIG. 2 in the "tripped" mode.

Upon experiencing a current overload condition the shape memory alloy element 38 becomes heated through resistance heating. When this occurs the shape memory alloy element 38 goes through a transformation from martensite to austenite and then reverts to its undeformed, shortened length so as to pull the flexure arm 36 away from the latching portion 22 of the pivotable arm 20. In this way the shape memory alloy element 38 cooperates with the flexure arm 36 to remove the restraining of the pivotable arm 20. Since the flexure arm 36 is no longer restraining the pivotable arm 20 the biasing means now causes the pivotable arm 20 to pivot in the direction of arrow 44, as shown in FIG. 3, and break the electrical contact between the contact portion 24, the contact arm 34 and the exterior contact 16. Thus, when the current overload condition occurs, the circuit breaker trips and appears as in FIG. 3. Indicating means 18 has now been rotated upwardly and thus is no longer flush with the housing 12.

In order to accommodate the pivoting of the pivotable arm, the pivotable arm 20 contains a cavity 46 to accommodate the movement of the pivotable arm past the shape memory alloy element 38.

The circuit breaker may be reset after eliminating the overload condition by simply pushing down on the pivotable arm. Flexure arm 36 has by now deformed the shape memory alloy element 38 into its extended length configuration. Then, the latching portion 22 of the pivotable arm latches onto the flexure arm 36 so that the circuit breaker is now reset.

A particular advantage of the invention is that it is suitable for high D.C. voltage and low amperage applications. This is the worse possible case for a circuit breaker due to the potential for arcing. Other advantages of the invention are that the circuit breaker is inexpensive to produce and is small and compact. Too, the circuit breaker is faster and simpler than conventional bimetal circuit breakers.

A still further advantage of the circuit breaker according to the invention is that it has low insertion loss. That is, it has been found that, for example, ¼ amp circuit breakers according to the invention have a resistance of about 0.5 ohms. This resistance should be compared to 10–20 ohms for a conventional circuit breaker or fuse. It is most desirable to have a circuit breaker with as low a resistance (low insertion loss) as possible, preferably less than 10 ohms and most preferably less than 1 ohm. The reason for wanting low insertion loss, of course, is that the higher the resistance, the more heat that is generated and the more power that is consumed.

As is apparent to those skilled in the art the degree of overload that the circuit breaker just described will accommodate can be adjusted by adjusting the gage of the shape memory alloy element and the strength of the flexure arm or by changing the shape of the shape memory alloy element, such as making it into a helical coil. In this manner the circuit breaker can be adjusted to accommodate very low amperage conditions or very high amperage conditions. For further design information the skilled artisan is directed to the booklet, "Control Design With VEASE TM" (incorporated by reference herein), available from Raychem Corporation, the assignee of the instant application.

In a preferred embodiment of the invention the exterior contacts are barrel or barrel-like contacts. When this is the case, the circuit breaker is a barrel circuit breaker. Alternatively, the contacts may be configured to fit in a cylindrical holder although the contacts themselves may not be cylindrical.

Upon the tripping of the circuit breaker, the pivotable arm 20 pops up out of the housing 12. When this occurs, indicating means 18 becomes visible, thereby indicating that the circuit breaker has tripped. However, in addition to this indicating means, there may be other means contemplated within the scope of the invention to indicate that the circuit breaker has tripped. For example, the pivotable arm may include written indicia thereon or an alarm may sound.

There are several shape memory alloys which are suitable for the shape memory alloy elements of the invention. These shape memory alloys may include any of the copper base and nickel/titanium base shape memory alloys well known to those skilled in the art. However, a particuarly preferred shape memory alloy for the instant invention is a nickel/titanium/copper shape memory alloy such as that disclosed in Harrison U.S. Pat. No. 4,565,589, which is incorporated herein by reference.

The above discussion has been confined almost exclusively to describing the invention in the preferred embodiment of a circuit breaker. However, it is contemplated within the scope of the invention that the invention may have applicability to other electromechanical devices such as relays as well as other thermostatic switching devices.

It is also contemplated within the scope of the invention that the internal workings of the circuit breaker, that is the actuator mechanism itself, may have utility as a separate article of commerce and may be included in a different housing or in a different environment so as to form an article other than a circuit breaker. The actuator mechanism itself may comprise just the pivotable arm, the means for biasing, the bifurcated member and the shape memory alloy element. The advantages of such an actuator mechanism go beyond its use within the circuit breaker in that this particular actuator mechanism is extremely small, compact and can accommodate a variety of operating conditions.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

We claim:

1. An actuator mechanism comprising:

a pivotable arm having a latching portion and a contact portion;

a means for biasing exerting a biasing force with respect to said pivotable arm;

a bifurcated member having a contact arm in touching relationship with the contact portion of said pivotable arm and a flexure arm cooperating with the latching portion of said pivotable arm, the flexure arm releasably restraining said pivotable arm against the biasing force exerted by said biasing means; and a shape memory alloy element operatively connected to the flexure arm wherein when said element is heated, said element cooperates with the flexure arm to remove the restraining of said pivotable arm, thereby releasing said pivotable arm to pivot and break the touching relationship of the contact portion and the contact arm.

2. The actuator mechanism of claim 1 further comprising means for indicating when said pivotable arm has been released.

3. The actuator mechanism of claim 1, wherein said shape memory alloy element is made from a nickel/-titanium shape memory alloy.

4. The actuator mechanism of claim 3, wherein said shape memory alloy is a nickel/titanium/copper shape memory alloy.

5. A low loss circuit breaker comprising:

a housing;

two exterior contacts, one at each end of said housing;

a pivotable arm having a latching portion and a contact portion, the contact portion being in electrical contact with one of said exterior contacts;

a means for biasing exerting a biasing force with respect to said pivotable arm;

a bifurcated member having a contact arm in touching relationship with the contact portion of said pivotable arm and is in electrical contact with the one of said exterior contacts through the contact portion of said pivotable arm and a flexure arm cooperating with the latching portion of said pivotable arm, the flexure arm releasably restraining said pivotable arm against the biasing force exerted by said biasing means; and a shape memory alloy element operatively connected between the other of said exterior contacts and the flexure arm wherein when said element is heated, said element cooperates with the flexure arm to remove the restraining of said pivotable arm, thereby releasing said pivot table arm to pivot and break the electrical contact between the contact portion, the contact arm and the one of said exterior contacts.

6. The circuit breaker of claim 5 further comprising means for indicating when said pivotable arm has been released.

7. The circuit breaker of claim 5 wherin said shape memory alloy element is made from a nickel/titanium shape memory alloy.

8. The circuit breaker of claim 7 wherein said shape memory alloy is a nickel/titanium/copper shape memory alloy.

9. The circuit breaker of claim 5 wherein said exterior contacts are barrel or barrel-like contacts.

10. The circuit breaker of claim 5 wherein said exterior contacts are at least partially barrel-shaped.

* * * * *